United States Patent [19]

Voss et al.

[11] Patent Number: 4,633,208

[45] Date of Patent: Dec. 30, 1986

[54] MAGNETIC MULTI-POLE ARRANGEMENT OF THE NTH ORDER

[75] Inventors: Erich Voss, Bad Neustadt/Saale; Hermann Wollnik, Fernwald, both of Fed. Rep. of Germany

[73] Assignee: Siemens Aktiengesellschaft, Munich and Berlin, Fed. Rep. of Germany

[21] Appl. No.: 614,917

[22] Filed: May 29, 1984

[30] Foreign Application Priority Data

Jun. 10, 1983 [DE] Fed. Rep. of Germany ..... 3321117

[51] Int. Cl.[4] ..... H01F 7/00; H01F 1/00

[52] U.S. Cl. ..... 335/210; 335/209

[58] Field of Search ..... 335/210, 306, 209, 304; 315/5.41; 250/396, 396 ML

[56] References Cited

U.S. PATENT DOCUMENTS

| | | | |
|---|---|---|---|
| 2,157,182 | 5/1939 | Maloff | 335/210 |
| 2,718,606 | 9/1955 | Zuerker | 335/210 |
| 3,141,117 | 7/1964 | Scheer et al. | 335/210 |
| 3,831,121 | 8/1974 | Oster | 335/210 |
| 4,153,889 | 5/1979 | Ikegami | 335/209 |
| 4,381,490 | 4/1983 | Peters | 335/210 |
| 4,494,040 | 1/1985 | Moretti | 315/5.41 |
| 4,549,155 | 10/1985 | Halbach | 335/306 |

*Primary Examiner*—Harold Broome

*Attorney, Agent, or Firm*—F. W. Powers; J. L. James

[57] ABSTRACT

An nth order magnetic multipole arrangement for influencing the trajectory of charged particles is disclosed. In order to avoid using structural parts that are manufactured separately, it has been found to provide as the multipole arrangement, the stator of a multi-pole alternating current machine, the stator winding of which is fed by a voltage source in such a way that the produce of current and number of turns (number of ampere turns) in a groove or group of grooves disposed under the azimuth angle $\theta$ is proportional to cos (n $\theta$), n corresponding to the order (order number) of the multipole arrangement, and the factors a and b being taken from the ratio b/a which states the orientation of the multipole relative to the azmith angle $\theta=0$. As the multipole arrangement there may be provided also a stator, excited by permanent magnets, of a direct current machine.

6 Claims, 5 Drawing Figures

MAGNETIC MULTI-POLE ARRANGEMENT OF THE NTH ORDER

BACKGROUND OF THE INVENTION

The invention relates to a magnetic multi-pole arrangement of the nth order to control the trajectories of charged particles.

The focusing of ions or electron beams can be accomplished with electrical or magnetic fields. For focusing by means of magnetic fields, magnetic quadrupole lenses (four-pole lenses) are frequently used. U.S. Pat. No. 4,135,114, for example, discloses quadrupole lens for focusing of the electron beam in a color picture tube. This quadrupole lens consists of a square opening introduced in a plate, whose side edges are magnetized with alternating polarity. In this manner a four-pole magnetic field is formed, whose optical axis z coincides with the direction of propagation of the particle beam. On the x and y axes, the particles in one axial direction are deflected toward the optical axis-focused—and in the other axial direction they are deflected away from the optical axis-defocused.

Magnetic quadrupole lenses are of great importance for the focusing of the particle streams in particle accelerators. In order to achieve a sufficient deflection of the energy-loaded particles, however, strong magnetic fields are necessary. In the case of a quadrupole, for the radial component $B_r$ of the magnetic flux density at a distance r from the optical axis and as a function of the azimuth angle $\theta$, the following equation applies:

$$B_r = B_T(r/G_0)\cdot\sin 2\theta,$$

where $B_T$ is the magnetic flux density at the middle of the pole shoe and $2G_0$ is the aperture diameter of the opening of the quadrupole that is bounded by the pole shoes. The desired distribution of the magnetic flux density is best achieved, if, as shown in FIG. 1, four pole shoes in the shape of hyperbolas are used, which are electrically excited and have alternating magnetic poles.

SUMMARY OF THE INVENTION

The object of the invention is to provide a multi-pole arrangement with a $B_r = B_T(r/G_0)^{n-1}\cdot\sin(n\theta)$, with $n=1, 2, 3, 4, \ldots$, and which thus includes a quadrupole with $n=2$, which does not, as is usually the case, consist of an arrangement with pole shoes formed in a manner suitable for $n=2$, but instead of components that do not have to be manufactured separately. A further goal of the invention is to achieve, by using a multipole arrangement of this kind, substantial energy savings compared with existing arrangements.

The object is achieved according to the invention, by using as the multi-pole arrangement the stator of a multi-phase alternating current machine, whose stator winding is fed from a voltage source in such a manner that the product of the current and the number of windings (ampere-turns) in a groove or group of grooves included in the azimuth angle $\theta$ is proportional, or approximately proportional, to $\cos(n\theta)$ or to $a\cdot\cos(n\theta)+b\cdot\sin(n\theta)$, where n is the order number of the multi-pole arrangement and the coefficients a and b are taken from the ratio b/a, which gives the orientation of the multi-pole with respect to the azimuth angle $\theta=0$. In this way a magnetic multi-pole arrangement can be constructed from elements that are currently being mass manufactured and are consequently relatively inexpensive.

It is possible to superimpose the strength of the individual multi-pole that is desired in each case on several multi-poles of varying orders by making the product of the current and the number of windings in a groove or group of grooves included in the azimuth angle $\theta$ proportional to the sum $$(iw)_s = \sum_{n=k}^{\infty} (iw)_{2n}\cdot\cos(n\theta)$$

or proportional to the sum $$(iw)_s = \sum_{n=k}^{\infty} [a(iw)_{2n}\cdot\cos(n\theta) + b(iw)_{2n}\cdot\sin(n\theta)]$$

where $(iw)_{2n}$ indicates in each case the maximum number of ampere-turns assigned to the corresponding nth multi-pole.

A superimposition of this kind can be easily achieved by using as the alternating current machine an n-pole, three-phase machine whose phase windings consist in each case of two separate coil sets, with one branch of these coil sets lying in a groove or group of grooves included within the azimuth angle $\theta$ and the other branch lying in a groove or group of grooves included within the azimuth angle $-\theta$, and by causing a current to flow through one of the coil sets such that the product of the current and the number of windings of this coil set is proportional to $$\sum_{n=k}^{\infty} a(i\cdot w)_{2n}\cdot\cos(n\theta)$$

and by causing a current to flow through the other coil set such that the product of the current and the number of windings of this coil set is proportional to $$\sum_{n=k}^{\infty} b(i\cdot w)_{2n}\cdot\sin(n\theta).$$

A superimposition of this kind can also be accomplished by using as the alternating current machine an n-pole, three-phase machine whose phase windings consist in each case of two separate coil sets, with one branch of these coil sets lying in a groove or group of grooves included within the azimuth angle $\theta$ and the other branch lying in a groove or group of grooves included within the azimuth angle $\theta+\pi/k$, and by causing a current to flow through one coil set such that the product of the current and the number of windings of this coil set is proportional to $$\sum_{n=k}^{\infty} a[(iw)_{2(k+2n)}\cos(k+2n)\theta + (iw)_{2(k+2n+1)}\sin(k+2n+1)\theta]$$

and by causing a current to flow through the other coil set such that the product of the current and the number of windings of that coil is proportional to $$\sum_{n=k}^{\infty} b[(iw)_{2(k+2n)}\sin(k+2n)\theta + (iw)_{2(k+2n+1)}\cos(k+2n+1)\theta]$$

A distribution of the numbers of ampere-turns that approximates a cosine curve is accomplished without additional expense by using as the alternating current machine an n-pole, three-phase machine in which the coils forming a phase conductor are connected, reversed, in parallel to the series circuit of the coils forming the two other phase conductors. Minor changes in the orientation of the multi-pole field are made possible by connecting an active resistor in parallel to one of the two phase conductors arranged in series. With an adjustable active resistor, the orientation of the multi-pole field can accordingly be reset at any time. On the other hand, a change in the orientation of the multi-pole field can also be made possible by connecting the individual coils to a number of adjustable dc current sources.

A substantial energy saving, with the simultaneous use of a mass-produced product as a multi-pole, can be achieved if a stator of a dc current machine, which is excited by permanent magnets, is used as the multi-pole arrangement.

An especially strong magnetic field, caused by the reduction of leaks is achieved by having the entire surface of the pole pieces of the stator, with the exception of the surface facing the stator opening, covered with permanent magnets.

The magnetic field and, accordingly, the effect of the multi-pole can be changed by mounting an exciter coil on the pole pieces in addition to the permanent magnets.

The construction of a multi-pole arrangement with permanent magnets and an electrical auxiliary exciter becomes very simple, due to the fact that only the radial lateral surfaces of the pole pieces are covered with permanent magnets. The magnetic field of the multi-pole arrangement can also be strengthened by having the radial lateral surfaces of the pole pieces covered with rare-earth-cobalt magnets, at least in the area adjacent to the stator opening. A rotation of the magnetic field of the multi-pole arrangement, at least through small angles, is accomplished, according to another embodiment of the invention by making it possible to set the current in the exciter coils of successive pole pieces at different levels.

Other features and advantages of the present invention will become apparent from the following detailed description, and from the claims.

For a full understanding of the present invention, reference should now be made to the following detailed description and to the accompanying drawings.

DETAILED DESCRIPTION

Figure 1:
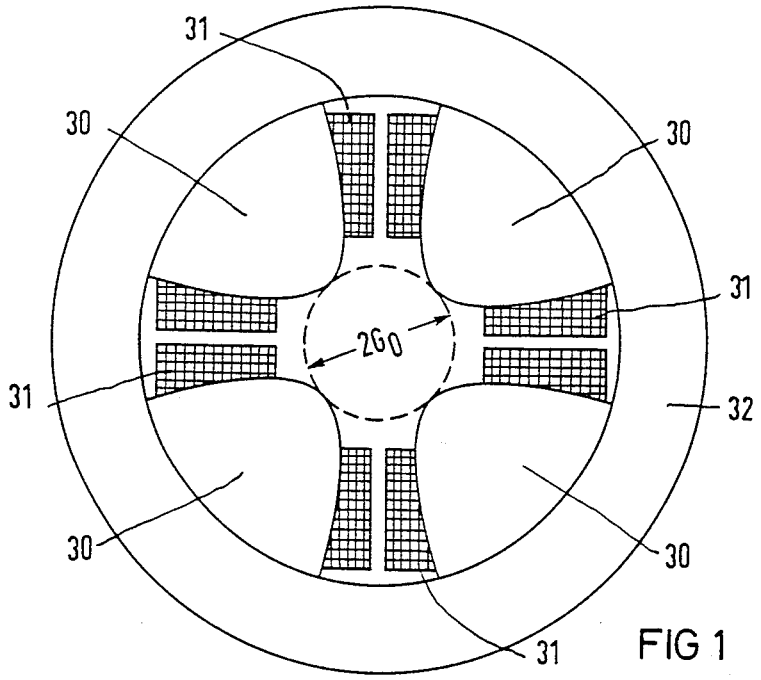
FIG. 1 shows a quadrupole with pole shoes in the form of hyperbolas in accordance with the state of the art.

In the case of the quadrupole shown in FIG. 1, number 30 designates hyperbolic pole shoes on which exciter coil 31 is mounted. By means of this exciter coil 31, pole shoes 30 are magnetically excited in such a manner that successive pole shoes exhibit a different magnetic polarity. The pole shoes are connected with one another by means of return pole piece 32.

Figure 2:
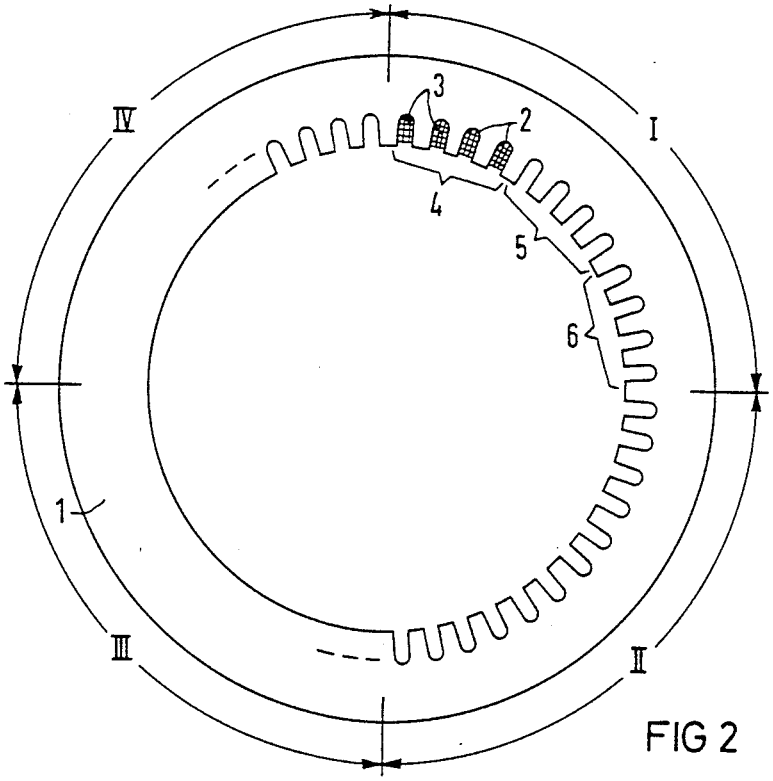
FIG. 2 shows a stator of an alternating current machine used as a multi-pole arrangement.

In FIG. 2, 1 designates the stator of a four-pole alternating current machine, in whose grooves 2 a conventional three-phase winding 3 has been introduced. The ranges of the individual poles are indicated by I–IV. In the embodiment shown, twelve grooves 2 have been provided for each pole, so that in a three-phase machine, four grooves are available for each phase conductor 4 to 6.

Figure 3:
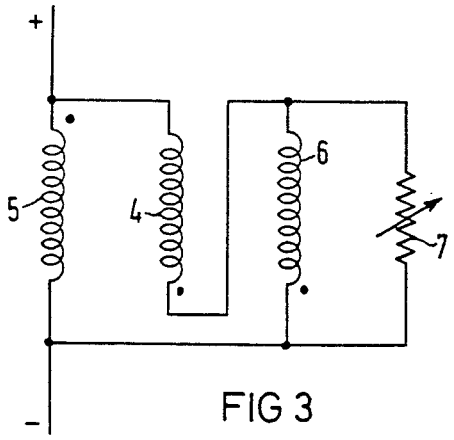
FIG. 3 shows the circuitry for the phase winding of the alternating current machine shown in FIG. 2.

As shown in the circuit diagram in FIG. 3, phase conductors 4 and 6 are connected with one another in series and, in parallel with phase conductor 5, to a dc voltage source. In addition, an adjustable active resistor 7 is connected in parallel to phase conductor 6. The following equations apply to the three-phase operation of an electrical machine for the current in the individual phase conductors:

$$i_1 = i_0 \cdot \cos wt$$

$$i_2 = i_0 \cdot \cos\left(wt + \frac{2\pi}{3}\right)$$

$$i_3 = i_0 \cdot \cos\left(wt + \frac{4\pi}{3}\right)$$

For the time $t = 0$, it follows that $i_1 = i_0$ and $i_2 = i_3 = -i_0/2$.

Since the two phase conductors 4 and 6 are connected in series, it is easy to make the current in these phase conductors equal to half the current in phase conductor 5, which is connected independently to the dc voltage source. The minus sign for the currents $i_2$ and $i_3$ means that corresponding phase conductors 4 and 6 must be connected to the dc voltage source with winding in the reverse direction to that of phase conductor 5.

With the circuit shown in FIG. 3, it is therefore easy, even when using a dc voltage source in a fixed voltage, to produce a four-pole magnetic field in a distribution of the magnetic flux density that is approximately in the form of a cosine curve over the range of a pole. The result of connecting active resistor 7 to one of phase conductors 4 and 6 is to rotate the magnetic field through a small angle from the magnetic field that is generated by the phase conductors in the absence of such a resistor. The angle of rotation can be determined by an adjustment of resistor 7. Such a rotation can also be produced by an alteration of the current in the phase conductors. This change can be accomplished by means of an adjustable dc voltage source.

A superimposition of multi-poles of different ordrers is achieved if the number of ampere-turns in a groove or group of grooves included within the azimuth angle O fulfills the condition $$(iw)_s = \sum_{n=k}^{\infty} (i \cdot w)_{2n} \cdot \cos(n\theta),$$

where 2k designates the multi-pole of the lowest order that is present. For k=2, superimposition of a quadrupole, a hexapole, etc. is achieved. However, in this case there is no dipole component.

By the azimuth angle $\theta$ is meant the angle formed by the groove or group of grooves with the coordinates of a plane perpendicular to the stator axis.

The desired distribution of current over the azimuth angle O can be accomplished in a number of ways. One possibility, for example, is to arrange each individual coil with its first branch in the groove included within the azimuth angle $\theta$ and with its second branch in the groove included within the azimuth angle $-\theta$, with the number of ampere-turns of such a coil corresponding to the sum $(iw)_s$ that is described above. The strength of the individual multi-poles can be varied separately through the use of a power pack that can be regulated separately for each individual coil, or by means of an adjustable resistor connected in series or parallel to the individual coils. By this means, the distribution of the current over the azimuth angle can be altered even during operation.

A superimposition of multi-poles of different orders, whose orientation with regard to the azimuth angle $\theta=0$ is to be variable, can be obtained if the number of ampere-turns in a groove or group of grooves included within the azimuth angle $\theta$ fulfills the condition $$(iw)_s = \sum_{n=k}^{\infty} a(iw)_{2n} \cdot \cos(n\theta) + b(i \cdot w)_{2n}\sin(n\theta)$$

where the value of a and b is smaller than or equal to 1. In this case 2k=2 represents the multi-pole of the lowest order (a dipole), and the ratio of b to a the tangent of the angle by which the orientation of the multi-pole superimposition is rotated compared to the orientation corresponding to the values b=1 and a0.

The desired distribution of the number of ampere-turns over the azimuth angle $\theta$ can again be achieved in a number of ways. One advantageous possibility consists of selecting the width of the individual coils in such a manner that they are arranged with their first branch in a groové included within the azimuth angle $\theta$ and with their second branch in a groove included within the azimuth angle $-\theta$. The number of ampere-turns must correspond to the sum for $(i \cdot w)_s$ described above. It is possible to change the ratio of b to a during operation if the current in the individual coils is changed by means of a resistor network or through the use of a power pack that can be adjusted accordingly.

Another advantageous possibility for achieving any desired distribution of the numbers of ampere-turns is afforded if the entire winding of the machines' stator consists of two separate partial windings. In this case, each groove contains a branch of a coil belonging to one partial winding and a branch of a coil belonging to the other partial winding. The width of the coil is selected in such a manner that the coils can be arranged with their first branch in a groove included within the azimuth angle $\theta$ and with their second branch in a groove included within the azimuth angle $-\theta$. The number of ampere-turns of the coil belonging to one partial winding is in this case proportional to $$\sum_{n=k}^{\infty} a(i \cdot w)_{2n} \cdot \cos(n\theta)$$

and that of the coil belonging to the other partial winding is proportional to $$\sum_{n=k}^{\infty} b(i \cdot w)_{2n} \cdot \sin(n\theta).$$

The numbers of ampere-turns so specified can be produced, for the same current, in the two partial windings by having appropriate numbers of windings on the individual coils. If, on the other hand, we start with identical numbers of windings, the currents in the coils must be varied accordingly; or both possibilities can be combined.

Figure 4:
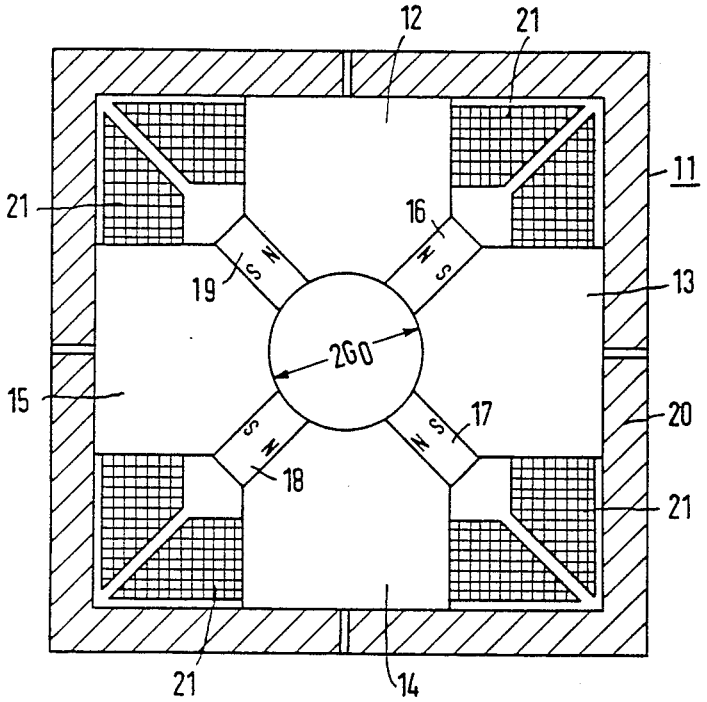
FIG. 4 shows a stator of a direct current machine excited by permanent magnets used as a multi-pole arrangement.

In FIG. 4, 11 is used to designate the four-pole stator of a dc machine. This stator 11 has four pole pieces 12 to 15 made of ferromagnetic material, between which radially extended permanent magnets 16 to 19 are inserted. Pole pieces 12 to 15 are fastened to return pole piece 20. In addition, supplementary exciter coil 21 is mounted on each of the pole pieces 12 to 15.

N and S indicate the polarization of permanent magnets 16 to 19. The permanent magets 16 to 19 are introduced between the pole pieces 12 to 15 in such a manner that in each case the successive pole pieces have a different polarity.

The opening in stator 11 corresponds to aperture diameter $2G_0$. In the embodiment shown in in FIG. 4, pole pieces 12 to 15 are concave on the side adjacent to the stator opening. In order to achieve a specified distribution of the magnetic field, the shape of the pole pieces at this point can also be designed in other ways. For example, the pole pieces can protrude with convex tips in the shape of a hyperbola, so as to approximate the shape of the pole shoes shown in in FIG. 1. By designing the shape of the pole shoe surface in the vicinity of the aperture in an appropriate way, it is possible to generate a magnetic field that consists of a superimposition of magnetic fields of various orders.

The use of permanent magnets 16 to 19 to generate the magnetic field results in substantial energy savings compared with magnetic fields that are generated exclusively by electricity. The introduction of a supplementary, electrically fed exciter coil 21 offers a means of adjusting the field. According to the direction of the current in this exciter coil in each case, the magnetic field generated by the permanent magnets can be intensified or weakened. In addition, it is possible to feed exciter coils 21 of successive pole pieces, for example pole pieces 12 and 13, with different currents, so that a slight rotation of the magnetic field is achieved.

It is also possible to control the magnetic field, in the case of a stator of this kind that is excited by permanent magnets by the introducton of adjustable leakage paths. Through the use of leakage paths of this kind, a part of the magnetic flux proceeding from the permanent magnets parallel to the pole pieces is short-circuited, so that the magnetic field is weakened in accordance with the short-circuited flux.

To produce especially strong magnetic fields, it is advantageous if at least in the vicinity of the stator opening rare-earth-cobalt magnets (samarium-cobalt-magnets) are introduced. Ferrite magnets can be used in the area lying further back.

Figure 5:
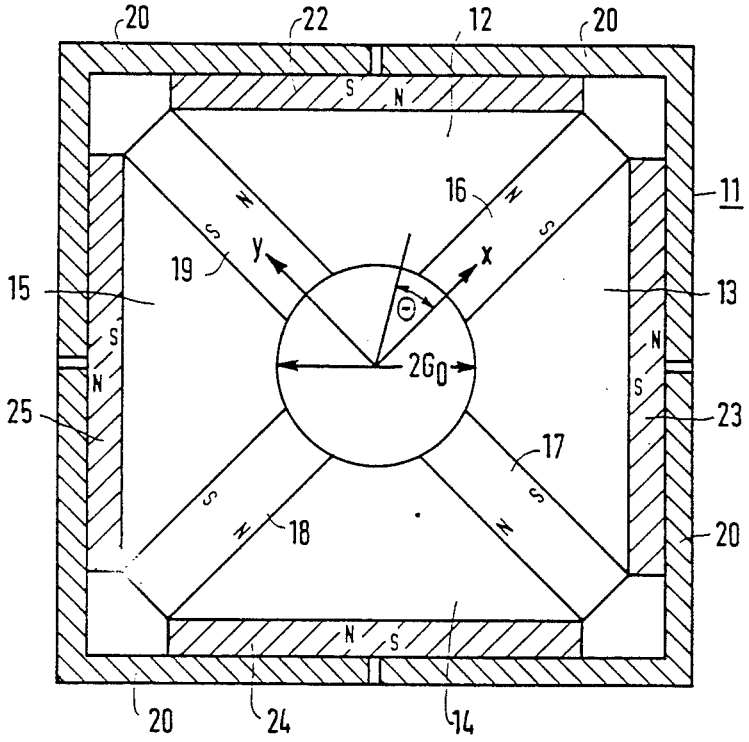
FIG. 5 shows a stator of a direct current machine excited by permanent magnets covering the inner surface of the pole pieces except for the stator opening surface.

If electrical exciter coil 21 is dispensed with, then, as shown in FIG. 5 in order to strengthen the magnetic field, additional permanent magnets 22 to 25, in particular, ferrite magnets, can be inserted between pole pieces 12 to 15 and return pole-piece 20.

In the embodiment, a four-pole stator is shown. Stators with different numbers of poles can also be used, if a magnetic field with a higher or lower number of poles is needed to control the particle current.

There has thus been shown and described a magnetic multi-pole arrangement of the nth order, which fulfills all the objects and advantages sought therefor. Many changes, modifications, variations and other uses and applications of the subject invention will, however, become apparent to those skilled in the art after considering the specification and the accompanying drawings which disclose embodiments thereof. All such changes, modifications, variations and other uses and applications which do not depart from the spirit and scope of the invention are deemed to be covered by the invention which is limited only by the claims which follow.

What is claimed is:

1. A magnetic multi-pole arrangement of the n-th order to control a trajectory of a charged particle characterized by:

said multi-pole arrangement comprises a stator of a three-phase, n-pole alternating current machine, said stator having a stator yoke with a plurality of grooves therein into which a typical three-phase stator winding is inserted; each phase of said three-phase winding includes two separate coil sets, with these coil sets having one branch in a groove or group of grooves included within an azimuth angle $\theta$ and the other branch in a groove or group of grooves included within an azimuth angle $-\theta$;

the individual phase coils of said three-phase stator winding are connected to a direct current voltage source, inducing a phase current to flow in each said phase coils so that a first current is caused to pass through one of the coil sets, such that the product of the current and the number of windings of that coil set is proportional to:

$$\sum_{n=k}^{\infty} a(i \cdot w)_{2n} \cdot \cos(n\theta)$$

and a second current is caused to pass through the other coil set, such that the product of the second current and the number of windings of that coil set is proportional to:

$$\sum_{n=k}^{\infty} b(i \cdot w)_{2n} \cdot \sin(n\theta);$$

where i is the respective phase current;

w, the number of turns in the respective phase coil;

n corresponds to the order of the multi-pole arrangement;

$\theta$ is the azimuthal angle, measured at a center of said stator, containing the grooves into which the phase coils are inserted; and a and b are coefficients given by the ratio b/a, which gives the orientation of each pole of the multi-pole arrangement with respect to the azimuth angle $\theta=0$.

2. A magnetic multi-pole arrangement of the n-th order to control a trajectory of a charged particle characterized by:

said multi-pole arrangement comprises a stator of a three-phase, n-pole alternating current machine, said stator having a stator yoke with a plurality of grooves therein into which a typical three-phase stator winding is inserted; each phase of said three-phase winding includes two separate coil sets, with these coil sets having one branch in a groove or group of grooves included within an azimuth angle $\theta$ and the other branch in a groove or group of grooves included within an azimuth angle $\theta+\pi/k$;

the individual phase coils of said three-phase stator winding are connected to a direct current voltage source, inducing a phase current to flow in each said phase coils so that a first current is caused to pass through one of the coil sets, such that the product of the current and the number of windings of that coil set is proportional to:

$$\sum_{n=k}^{\infty} a((iw)_{2(k+2n)}\cos(k+2n)\theta + (iw)_{2(k+2n+1)}\sin(k+2n+1)\theta)$$

and a second current is caused to pass through the other coil coil set, such that the product of the second current and the number of windings of that coil set is proportional to:

$$\sum_{n=k}^{\infty} b((iw)_{2(k+2n)}\sin(k+2n)\theta + (iw)_{2(k+2n+1)}\cos(k+2n+1)\theta);$$

where i is the respective phase current;

w, the number of turns in the respective phase coil;

n corresponds to the order of the multi-pole arrangement;

$\theta$ is the azimuthal angle, measured at a center of said stator, containing the grooves into which the phase coils are inserted; and a and b are coefficients given by the ratio b/a, which gives the orientation of each pole of the multi-pole arrangement with respect to the azimuth angle $\phi=0$.

3. A magnetic multi-pole arrangement of the n-th order to control a trajectory of a charged particle characterized by:

said multi-pole arrangement comprises a stator of a three-phase, n-pole alternating current machine, said stator having a stator yoke with a plurality of grooves therein into which a typical three-phase stator winding is inserted;

the individual phase coils of said three-phase stator winding are connected to a constant voltage source, inducing a phase current to flow in each said phase coils; and a product, iw, for each respective coil of the respective phase current, i, and the number of turns, w, in the respective phase coil which is proportional to cos ($n\theta$) or proportional to a·cos ($n\theta$)+b·sin ($n\theta$), where n corresponds to the order of the multi-pole arrangement;

$\theta$ is the azimuthal angle, measured at a center of said stator, containing the grooves into which the phase coils are inserted; and a and b are coefficients given by the ratio b/a, which gives the orientation of each pole of the multi-pole arrangement with respect to the azimuth angle $\phi=0$ wherein the coils forming one phase winding are connected, reversed, in parallel to the series circuit of the coils forming the two other phase windings.

4. The multi-pole arrangement according to claim 3, further comprising an active resistor connected in parallel to one of the two phase conductors that are connected in series.

5. The multi-pole arrangement according to claim 4, wherein the active resistor is adjustable.

6. The multi-pole arrangement according to claim 1, wherein each coil is connected to a different adjustable dc voltage source.

* * * * *